US005997330A

United States Patent [19]

Choy

[11] Patent Number: 5,997,330

[45] Date of Patent: Dec. 7, 1999

[54] CONNECTOR WITH LATCH DEVICE

[75] Inventor: Edmond Choy, Union City, Calif.

[73] Assignee: Hon Hai Precision Ind. Co., Ltd., Taipei Hsien, Taiwan

[21] Appl. No.: 09/041,879

[22] Filed: Mar. 12, 1998

[51] Int. Cl.[6] ..... H01R 13/62

[52] U.S. Cl. ..... 439/328

[58] Field of Search ..... 439/326, 327, 439/328, 329, 152–160, 630–637, 541.5

[56] References Cited

U.S. PATENT DOCUMENTS 5,203,714 4/1993 Tuan ..... 439/326

*Primary Examiner*—Steven L. Stephan
*Assistant Examiner*—Eugene G. Byrd

[57] ABSTRACT

An electrical connector (10) includes an elongated insulative housing (12) defining a central slot (14) to receive a module (100) therein. A plurality of contacts are provided by two sides of the central slot (14) for mechanical and electrical engagement with the corresponding circuit pads on the module (100). A pair of platforms (18) are provided adjacent two opposite ends of the housing (12). A pair of latch devices (20) are provided at two opposite ends of the housing **(12*a*) wherein each latch device (20) includes a plastic member (22) and a metal member (24). The plastic member (22) integrally extends forward from the housing (12) with a locking head (48) proximate the distal free end thereof. The metal member (24) includes a first vertical plate (26) in abutment with the plastic member (22) for cooperation with the plastic member (22) during the lateral rotative movement of the plastic member (22), and a second vertical plate (30) for retaining the metal member (100) in position with regard to the housing (12). An upward tag (42) and a downward tag (44) respectively extend from a horizontal bend (38) which extends horizontally and inward from the lower edge (40) of the first plate (26) wherein the upward tag (42) provides linking-up between the metal member (26) and the plastic member (22), and the downward tag (44) provides a stopper function for preventing over-lateral movement of the plastic member (22) with regard to the housing (12)**.

17 Claims, 4 Drawing Sheets

CONNECTOR WITH LATCH DEVICE

BACKGROUND OF THE INVENTION

1. Field of the Invention

The invention relates to connectors, and particularly to the connector with latch devices at two opposite ends wherein each latch device includes the plastic member and the metal member in cooperation with each other.

2. The Related Art

Copending U.S. patent applications of Ser. No. 08/627,143 filed Apr. 3, 1996 and Ser. No. 08/692,823 filed on Jul. 29, 1996, disclose the so-called SO DIMMs (Small Outline Dual In-line memory modules), wherein the former discloses the latch device thereof essentially consisting of the plastic member and the metal member, and the latter discloses a high profile style thereof. Because it is desired to have a minimized dimension along the lengthwise direction of the connector, the structure disclosed in the aforementioned applications is required to be modified. It is understood that the main body of the housing of the connector can hardly be changed due to the necessity for compliance with the circuit layout of the inserted module, and thus reducing the dimension of the latch device at either end of the housing is regarded as only one way to implementation of miniaturization.

Therefore, an object of the invention is to provide a connector with latch devices at two opposite ends wherein each latch device includes a plastic member and a metal member while keeping a minimum dimension thereof.

SUMMARY OF THE INVENTION

According to an aspect of the invention, an electrical connector includes an elongated insulative housing defining a central slot to receive a module therein. A plurality of contacts are provided by two sides of the central slot for mechanical and electrical engagement with the corresponding circuit pads on the module. A pair of platforms are provided adjacent two opposite ends of the housing. A pair of latch devices are provided at two opposite ends of the housing wherein each latch device includes a plastic member and a metal member. The plastic member integrally extends forward from the housing with a locking head proximate the distal free end thereof. The metal member includes a first vertical plate in abutment with the plastic member for cooperation with the plastic member during the lateral rotative movement of the plastic member, and a second vertical plate for retaining the metal member in position with regard to the housing. An upward tag and a downward tag respectively extend from a horizontal bend which extends horizontally and inward from the lower edge of the first plate, wherein the upward tag provides linking-up between the metal member and the plastic member, and the downward tag provides a stopper function for preventing over-lateral movement of the plastic member with regard to the housing.

DETAILED DESCRIPTION OF THE PREFERRED EMBODIMENTS

References will now be in detail to the preferred embodiments of the invention. While the present invention has been described in with reference to the specific embodiments, the description is illustrative of the invention and is not to be construed as limiting the invention. Various modifications to the present invention can be made to the preferred embodiments by those skilled in the art without departing from the true spirit and scope of the invention as defined by appended claims.

Figure 1:
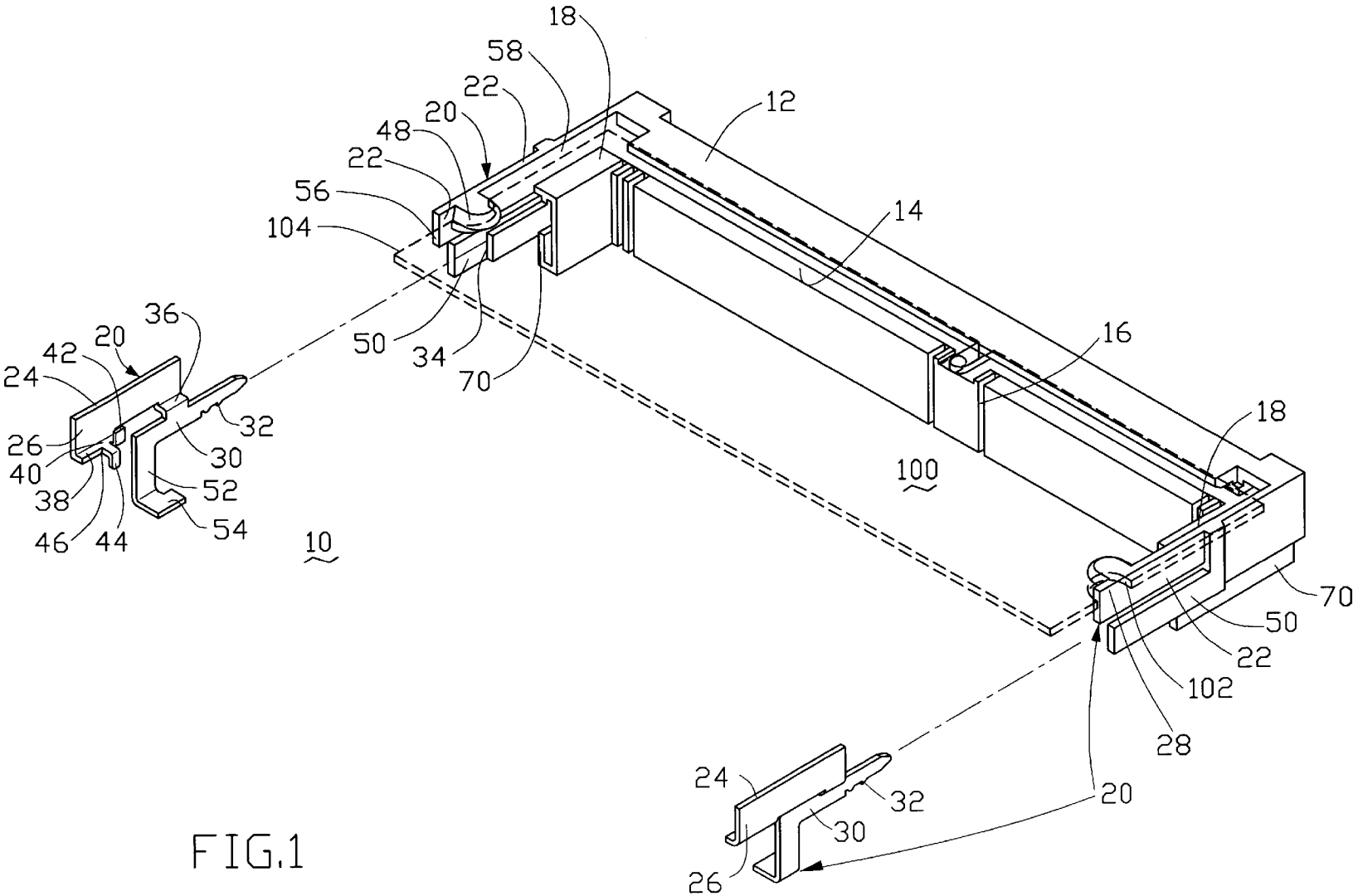
FIG. 1 is an exploded top perspective view of a present preferred embodiment of an electrical connector, according to the invention.
Figure 2:
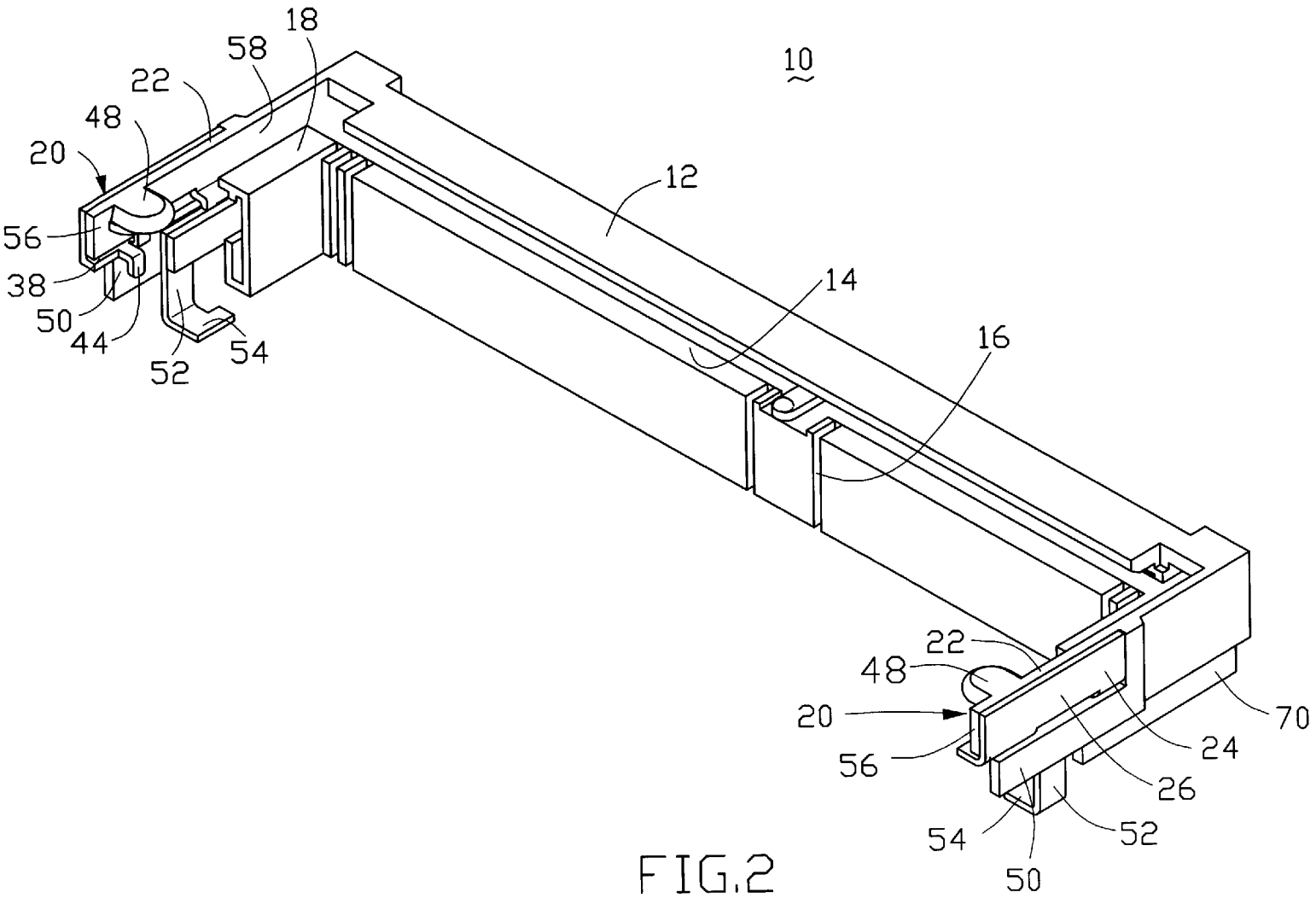
FIG. 2 is a top perspective view of the assembled connector of FIG. 1.
Figure 3:
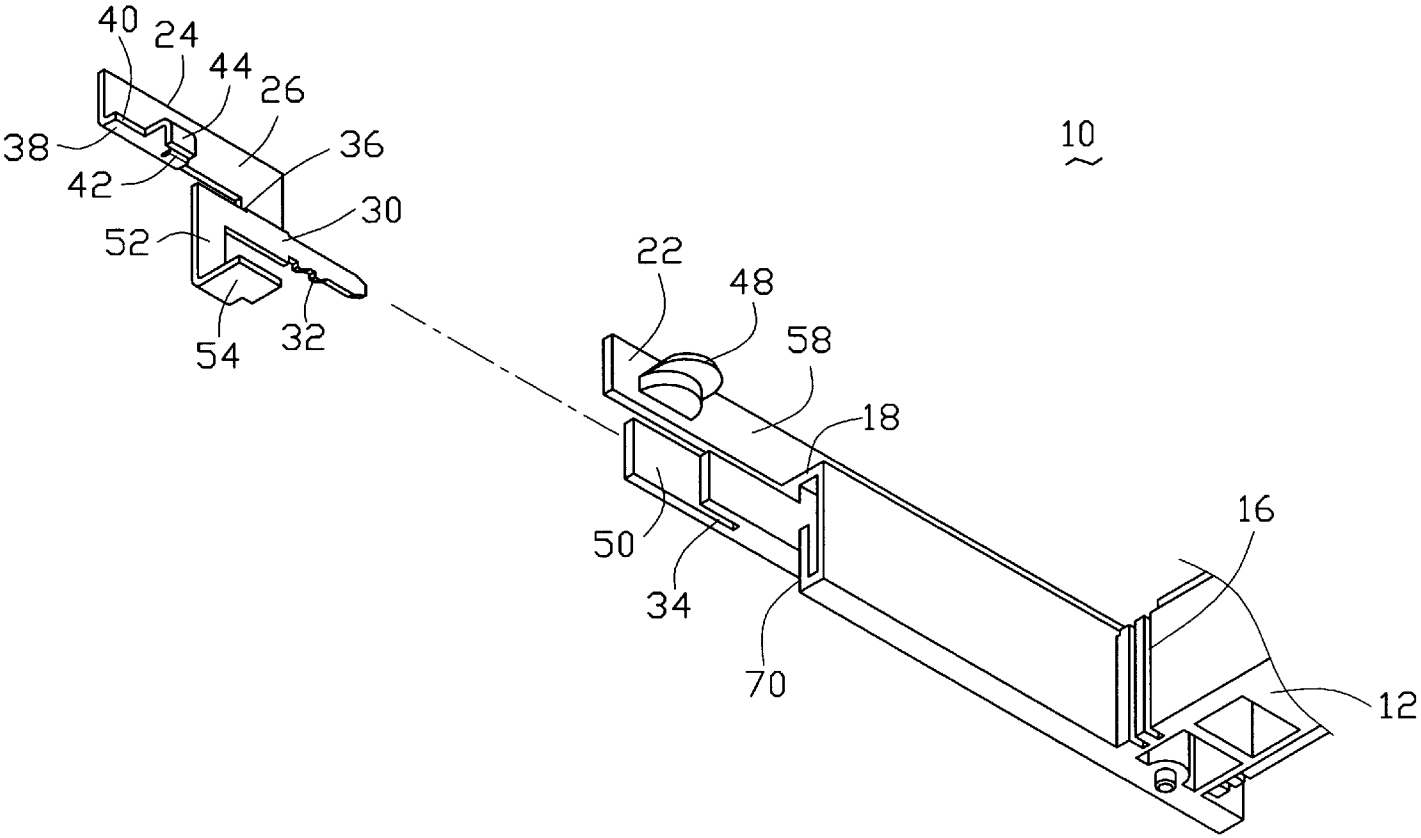
FIG. 3 is an enlarged partially exploded bottom perspective view of the connector of FIG. 1.
Figure 4:
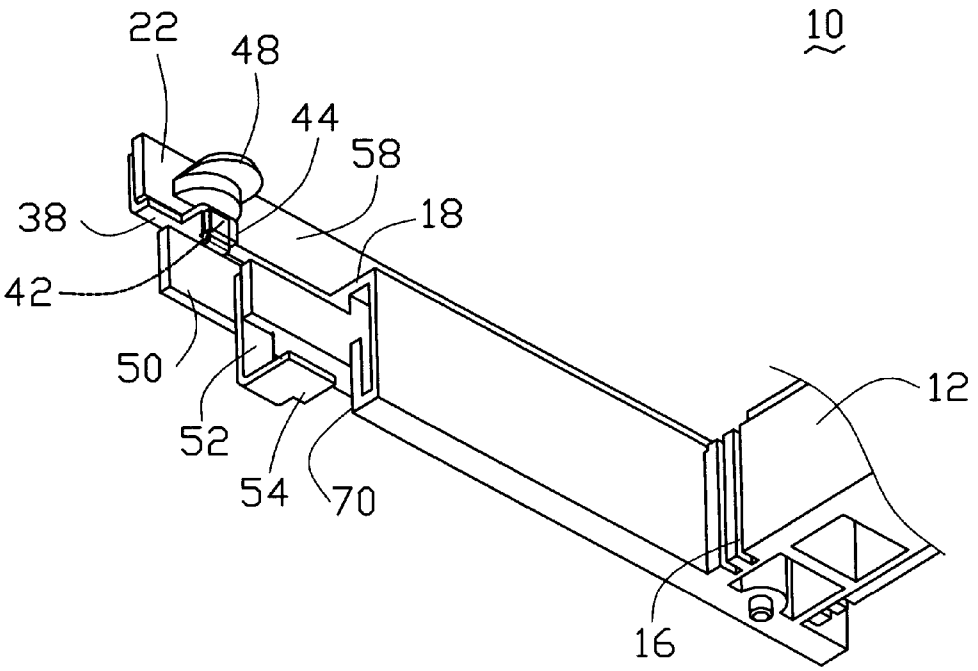
FIG. 4 is an enlarged bottom perspective view of the assembled connector of FIG. 1.

It will be noted here that for a better understanding, most of like components are designated by like reference numerals throughout the various figures in the embodiments. Attention is directed to FIGS. 1–4 wherein an electrical connector 10 includes an elongated insulative housing 12 defining a central slot 14 for receiving a module 100 therein. A plurality of passageways 16 are provided by two sides of the central slot 14 for receiving a corresponding number of contacts (not shown while referring to the aforementioned copending application Ser. No. 08/692,823 filed on Jul. 29, 1996) so that the contacts can be electrically and mechanically engaged with the corresponding circuit pads on the module 100.

A platform 18 is provided adjacent to either end of the housing 12. A latch device 20 is positioned at either end of the housing 12 and substantially positioned on the outer side of the corresponding platform 18. Each latch device 20 includes a plastic member 22 integrally extending forward from the housing 12 and generally above the corresponding platform 18, and a metal member 24 associated with the plastic member 22.

The metal member 24 includes a first vertical plate 26 closely/tightly abutting against the outer surface 28 of the plastic member 22, and a second vertical plate 30 with barbs 32 on the front portion thereof for retainable engagement within a corresponding aperture 34 in the platform 18 so as to retain the metal member 24 in position with regard to the housing 12.

The first plate 26 and the second plate 30 are not in the same vertical plane, and substantially offset from each other in a front-to-end direction by means of an offset section 36 integrally interconnecting and intermediating therebetween, wherein the second plate 30 is positioned on the inner side in comparison with the first plate 26.

A horizontal bend 38 is formed on the bottom lower edge 40 of the first plate 26 to form the whole structure thereof as an angle bar for reinforcement of the first plate 26. An upward tag 42 and a downward tag 44 respectively extend from the inner edge 46 of the bend 38 wherein the upward tag 42 is generally under the locking head 48 of the plastic member 22, and the downward tag beside the upward tag 42 faces to an end wall 50 of the platform 18 under the first plate 26 and the plastic member 22.

The second plate 30 further includes a downward extension 52 at its outermost end with a solder pad 54 at the bottom which is adapted to be mounted to the corresponding circuit paste of the PC board (not shown) on which the connector 10 is mounted.

It can be understood that after assembled, when the module 100 is retainably received within the connector 10, the module 100 is locked by the locking head 48 of the plastic member 22. Afterwards, the model 100 can be released from the connector 10 by manually outward pressing the lever end 56 of the plastic member 22 and having the plastic member 22 outward deflected with the locking head 48 disengaged from the module 100.

It can be noted the first plate 26 of the metal member 24 is moved along with the plastic member 22 because the upward tag 42 abutting against the inner surface 58 of the plastic member 22 cooperate with the first plate 26 abutting against the outer surface 28 of the plastic member 22. It is appreciated that the inner surface 58 of the plastic member 22 should designedly abut against the side edge 104 of the module 100, and since the upward tag 42 is generally positioned under the locking head 48 of the plastic member 22 and will be receivably positioned within the corresponding notch 102 of the module 100, such upward tag 42 will not improperly interfere with the module 100.

It is also contemplated that the downward tag 44 can butt the end wall 50 of the platform 18 when the plastic member 22 with the associated metal member 24 reaches its outermost position, thus preventing over-lateral movement of the latch device 20 and avoiding breaking occurring thereof.

It is seen that the extension 52 provides not only fastening the connector 10 to the PC board, but also an enhancement of the metal member 24 to resist outward bending of the first plate 26.

In comparison with the aforementioned copending applications, the invention has the metal member 24 extend and occupy almost in a vertical plane without any improper significant horizontal plate existing thereof, and therefore, latch device 18 can reduce its dimension, thus further resulting in minimizing the lengthwise dimension of the housing 12.

It is also noted that in this embodiment because it is a high profile connector 10 and the latch device 20 is positioned at the higher level of the housing 12, a recess or space 70 may be formed at the lower level of either end of the housing 12 for allowing other electrical components to be mounted on the PC board and occupy this space, thus facilitating the full layout usage of the PC board.

While the present invention has been described with reference to specific embodiments, the description is illustrative of the invention and is not to be construed as limiting the invention. Various modifications to the present invention can be made to the preferred embodiments by those skilled in the art without departing from the true spirit and scope of the invention as defined by the appended claims.

Therefore, person of ordinary skill in this field are to understand that all such equivalent structures are to be included within the scope of the following claims.

We claim:

1. An electrical connector comprising:

an elongated insulative housing defining a central slot;

a pair of platforms provided adjacent to two opposite ends of the housing;

a pair of latching devices provided at two opposite ends beside the corresponding platforms;

each of said latch devices including a plastic member and a metal member;

each of said plastic member integrally horizontally extending from the housing;

each of said metal member including a first vertical plate abutting against an outmost side of the plastic member, and a second vertical plate retaining the metal member in position with regard to the housing wherein the first plate of said metal member move along with the plastic member and the second plate is immovable, and a horizontal bend is formed on a lower edge of the first plate for reinforcement.

2. The connector as defined in claim 1, wherein said first plate is spaced and isolated from said second plate.

3. The connector as defined in claim 1, where said first plate and said second plate are not in a same vertical plane and substantially offset with each other in a front-to-end direction.

4. The connector as defined in claim 1, wherein an offset section interconnects and intermediates between said first plate and said second plate.

5. The connector as defined in claim 1, wherein an upward tag extends from said bend.

6. The connector as defined in claim 5, wherein said upward tag is positioned under a locking head of the plastic member.

7. The connector as defined in claim 1, wherein a downward tag extending from said bend.

8. The connector as defined in claim 7, wherein each of said platform further includes an end wall generally right under the first plate and adapted to abut against the downward tag when the plastic member with the associated first plate of the metal member reaches an outermost position.

9. An electrical connector comprising:

an elongated insulative housing defining a central slot;

a pair of platforms provided adjacent to two opposite ends of the housing;

a pair of latching devices provided at two opposite ends beside the corresponding platforms;

each of said latch devices including a plastic member and a metal member;

each of said plastic member integrally horizontally extending from the housing;

each of said metal member including a first vertical plate abutting against an outmost side of the plastic member, an upward tag cooperating with the first vertical plate to sandwich the plastic member therebetween for linking-up of the plastic member and the first plate wherein a downward tag integrally extending beside said upward tag can laterally butt an end wall of the housing as soon as the plastic member reaches a predeterminated position, thus preventing over-lateral movement of the plastic member and the associated first vertical plate of the metal member.

10. The connector as defined in claim 9, wherein said metal member further includes a second vertical plate spaced from said first plate for retaining the metal member in position with regard to the housing.

11. A high profile electrical connector comprising:

an elongated insulative housing defining a central slot;

a pair of platforms provided adjacent to two opposite ends of the housing;

a pair of latching devices provided at two opposite ends beside the corresponding platforms;

each of said latch devices including a plastic member;

each of said plastic member integrally horizontally extending from the housing; and an end wall extending from each of said platforms and spatially under the plastic member in a vertically coplanar relationship.

12. The connector as defined in claim 11, wherein said latch device further includes a metal member comprising a first vertical plate abutting against an outer surface of the plastic.

13. The connector as defined in claim 12, wherein said metal member further includes a second vertical plate abutting against an inner surface of the end wall.

14. The connector as defined in claim 13, wherein said first plate and said second plate are not in a same vertical plane.

15. The connector as defined in claim 12, wherein said metal member includes an upward tag and a downward tag moving along with the first plate to have the first plate linked to the plastic member and prevent the first plate and the plastic member from over-laterally moving.

16. A high profile electrical connector for horizontally mounting on a PC board, comprising:

an elongated insulative housing defining a central slot;

a pair of platforms provided adjacent to two opposite ends of the housing;

a pair of latching devices provided at two opposite ends beside the corresponding platforms;

each of said latch devices including a plastic member;

each of said plastic member integrally horizontally extending from the housing at a higher level with regard to the PC board wherein a recess defined generally between said plastic member and the PC board at either end of the housing, thus permitting the occupation of other adjacent electrical components therein for efficient usage on the PC board.

17. An electrical connector comprising:

an elongated insulative housing defining a central slot;

a pair of platforms provided adjacent to two opposite ends of the housing;

a pair of latching devices provided at two opposite ends beside the corresponding platforms;

each of said latch devices including a plastic member and a metal member;

each of said plastic member integrally extending horizontally from the housing;

each of said metal member including a first vertical plate abutting against an outmost side of the plastic member and a second vertical plate retaining the metal member in position with regard to the housing wherein the first plate of said metal member move along with the plastic member, and the second plate is immovable and includes an extension with a solder pad thereof.

* * * * *